US008028851B2

(12) United States Patent
Vovan et al.

(10) Patent No.: US 8,028,851 B2
(45) Date of Patent: Oct. 4, 2011

(54) ENHANCED TAMPER EVIDENT CONTAINER WITH TEAR-APART PARTS

(75) Inventors: Terry Vovan, Upland, CA (US); Jose Enriquez, South Gate, CA (US)

(73) Assignee: PWP Industries, Vernon, CA (US)

( * ) Notice: Subject to any disclaimer, the term of this patent is extended or adjusted under 35 U.S.C. 154(b) by 0 days.

(21) Appl. No.: 12/589,050

(22) Filed: Oct. 16, 2009

(65) Prior Publication Data

US 2010/0108680 A1 May 6, 2010

Related U.S. Application Data

(63) Continuation of application No. 11/446,622, filed on Jun. 5, 2006, now Pat. No. 7,631,776.

(51) Int. Cl.
*B65D 41/32* (2006.01)

(52) U.S. Cl. ..... 220/266; 220/276

(58) Field of Classification Search ..... 220/4.21, 220/4.24, 260, 266, 270, 276, 793; 215/901
See application file for complete search history.

(56) References Cited

U.S. PATENT DOCUMENTS

| | | | |
|---|---|---|---|
| 3,495,759 | A | 2/1970 | Bergstrom et al. |
| 3,572,579 | A | 3/1971 | Mueller |
| 3,773,207 | A | 11/1973 | Dokoupil et al. |
| 3,836,039 | A | 9/1974 | Seiferth et al. |
| 3,860,148 | A | 1/1975 | Sherin |
| 3,870,219 | A | 3/1975 | Reisman |
| 3,941,248 | A | 3/1976 | Moser et al. |
| 4,006,839 | A | 2/1977 | Thiel et al. |
| 4,091,930 | A | 5/1978 | Buchner et al. |
| 4,113,136 | A | 9/1978 | Abbott |
| 4,150,748 | A | 4/1979 | Mueller |
| 4,262,814 | A | 4/1981 | Roccaforte |
| 4,332,332 | A | 6/1982 | Ingemann |

(Continued)

FOREIGN PATENT DOCUMENTS

DE 4418935 12/1995

(Continued)

OTHER PUBLICATIONS

U.S. Appl. No. 11/230,978, filed Sep. 20, 2005.

(Continued)

*Primary Examiner* — Harry Grosso
(74) *Attorney, Agent, or Firm* — Baker Botts L.L.P.

(57) ABSTRACT

A container clearly indicates that it has been opened after a store clerk loads food into the base of the container and closes a covering of the container onto the base. The covering (16) includes a peripheral cover portion (22) that becomes fixed to a peripheral base portion (32) when the clerk initially closes the container. To thereafter open the container, a person forcefully lifts a tab (30) on the covering to tear the covering along a long tear line (26) that separates the peripheral cover portion (22) from a lid (24) formed by a radially inner covering portion. The base (12) is fixed to the peripheral covering portion (22), and together they form a base device (40). After the lid has been torn free of the peripheral covering portion, the lid can be closed and latched to the base device and then can be easily opened again. The container is supplied to the store with an adhesive strip (34) that the clerk activates by shining ultraviolet light (UV) at the adhesive after he/she places the loaded and initially closed container in a UV chamber (86), or mechanical latches with tabs engaging shoulders can be used.

25 Claims, 4 Drawing Sheets

U.S. PATENT DOCUMENTS 4,433,793 A 2/1984 Ingemann
4,453,666 A 6/1984 Gordon
4,520,943 A 6/1985 Nielsen
4,535,889 A 8/1985 Terauds
4,541,541 A 9/1985 Hickman et al.
4,560,082 A 12/1985 Sutch
4,610,371 A 9/1986 Karkiewicz
4,671,453 A 6/1987 Cassidy
4,678,083 A 7/1987 Anderson
4,721,210 A 1/1988 Lawrence et al.
4,742,935 A 5/1988 Schellenberg
4,747,510 A 5/1988 Mack
4,757,898 A 7/1988 Klein
4,759,463 A 7/1988 Mazoin
4,765,463 A 8/1988 Chanel
4,785,963 A 11/1988 Magley
4,792,054 A 12/1988 Weidman
4,819,824 A 4/1989 Longbottom et al.
4,854,472 A 8/1989 Semersky
4,874,096 A 10/1989 Tessera-Chiesa
4,878,595 A 11/1989 Uhlig
4,881,656 A 11/1989 Chumley et al.
4,890,758 A 1/1990 Gailus
4,930,656 A 6/1990 Blanchette
4,966,292 A 10/1990 Marino
4,966,294 A 10/1990 Mack et al.
4,974,735 A 12/1990 Newell et al.
4,998,622 A 3/1991 Drack
5,002,198 A 3/1991 Smith
5,007,231 A * 4/1991 Ingemann ..... 53/412
5,027,969 A 7/1991 Lesquir
5,040,695 A 8/1991 Adams et al.
5,052,572 A 10/1991 Pherigo
5,052,574 A 10/1991 McKinnon et al.
5,111,953 A 5/1992 Faust et al.
5,111,954 A 5/1992 Gaudreault
5,115,934 A 5/1992 Nelson
5,129,531 A 7/1992 Beck et al.
5,163,575 A 11/1992 Luch et al.
5,170,905 A 12/1992 Luch
5,219,074 A 6/1993 Mizuno et al.
5,219,087 A 6/1993 Christensson
5,249,694 A 10/1993 Nelson
5,283,940 A 2/1994 Luch et al.
5,287,959 A 2/1994 Hansen et al.
5,307,948 A 5/1994 Blackburn et al.
5,377,860 A 1/1995 Littlejohn et al.
5,405,629 A 4/1995 Marnocha et al.
5,421,473 A 6/1995 McCrossen
5,507,405 A 4/1996 Thomas et al.
5,507,406 A 4/1996 Urciuoli et al.
5,511,679 A 4/1996 Beck
5,511,680 A * 4/1996 Kinne ..... 206/276
5,528,814 A 6/1996 Luch et al.
5,545,375 A 8/1996 Tropsha et al.
5,573,134 A 11/1996 Chenault et al.
5,582,853 A 12/1996 Marnocha et al.
5,603,422 A 2/1997 Herrmann
5,607,075 A 3/1997 Burgdorf et al.
5,626,251 A 5/1997 Luburic et al.
5,683,771 A 11/1997 Tropsha
5,842,593 A 12/1998 Von Holdt
5,875,913 A 3/1999 Letica
5,897,011 A 4/1999 Brilliant et al.
5,931,291 A 8/1999 Sedon et al.
5,931,332 A 8/1999 Mygatt et al.
5,979,690 A 11/1999 Hartley
6,000,570 A 12/1999 Nelson
6,056,141 A 5/2000 Navarini et al.
RE36,729 E 6/2000 Luch et al.
6,116,501 A 9/2000 Hupp
6,135,304 A 10/2000 Wyslotsky
6,168,044 B1 1/2001 Zettle et al.
6,193,921 B1 2/2001 Nelson
6,257,435 B1 7/2001 Chedister et al.
6,276,529 B1 8/2001 Feehan, Jr.
6,279,774 B1 8/2001 Clute et al.
6,299,012 B1 10/2001 Redmond
6,328,355 B1 12/2001 Bortz
6,349,828 B1 2/2002 Sessions et al.
6,564,958 B1 5/2003 Ramsey et al.
6,572,909 B1 6/2003 Bagwell et al.
6,604,645 B1 8/2003 Vaupotic
6,772,901 B2 8/2004 Witt
6,899,245 B1 5/2005 Nelson
6,926,165 B2 8/2005 Conti
7,004,341 B2 2/2006 Shenkar et al.
7,011,221 B2 3/2006 Smith et al.
7,011,228 B2 3/2006 Ordiway
7,021,826 B2 4/2006 Benjamins
7,073,680 B2 7/2006 Boback et al.
7,097,058 B2 8/2006 Wellman et al.
7,114,619 B2 10/2006 Ellis et al.
7,118,003 B2 10/2006 Sellari et al.
7,191,931 B2 3/2007 Damkjaer
7,207,457 B2 4/2007 Schwarz
7,222,741 B2 5/2007 Chmela et al.
7,235,207 B2 6/2007 Gregory et al.
7,243,813 B2 7/2007 Krueger
7,246,714 B2 7/2007 Garg et al.
7,281,638 B2 10/2007 Hierzer et al.
7,311,218 B2 12/2007 Varadarajan
7,338,209 B2 3/2008 Winpenny
7,357,272 B2 4/2008 Maxwell
7,374,053 B2 5/2008 Herald et al.
7,475,780 B2 1/2009 Hinze et al.
7,475,788 B2 1/2009 Schwarz
7,549,540 B2 6/2009 Lee et al.
7,611,025 B2 11/2009 Nusbaum et al.
7,631,776 B2 * 12/2009 Vovan et al. ..... 220/266
7,757,848 B2 7/2010 Gelardi et al.
2002/0134783 A1 9/2002 Arshinoff
2002/0144998 A1 10/2002 Lees et al.
2003/0052133 A1 3/2003 Hayes et al.
2003/0127419 A1 7/2003 Shenkar et al.
2003/0160051 A1 8/2003 Ciccone
2003/0183636 A1 10/2003 Shih
2003/0189048 A1 10/2003 Luburic
2004/0045867 A1 3/2004 Appelbaum
2004/0118848 A1 6/2004 Marshall
2004/0134910 A1 7/2004 Colombo
2005/0252916 A1 11/2005 Varadarajan
2006/0003879 A1 1/2006 Buchman
2006/0006178 A1 1/2006 Foldesi et al.
2006/0011632 A1 1/2006 Caille
2006/0060578 A1 3/2006 Church et al.
2006/0144874 A1 7/2006 Solowiejko
2006/0163265 A1 7/2006 De Candido
2006/0175334 A1 8/2006 Schwarz
2006/0201946 A1 9/2006 Witt
2006/0249474 A1 11/2006 Sawyer et al.
2006/0255054 A1 11/2006 Vovan
2006/0261070 A1 11/2006 Robertson et al.
2006/0266750 A1 11/2006 Lesquir
2006/0278652 A1 12/2006 Vovan et al.
2006/0289549 A1 12/2006 Vovan
2007/0012710 A1 1/2007 Vovan
2007/0045317 A1 3/2007 Rosender et al.
2007/0062903 A1 3/2007 Norman et al.
2007/0062948 A1 3/2007 Albrecht et al.
2007/0095848 A1 5/2007 Galland et al.
2007/0108210 A1 5/2007 Alvares et al.
2007/0138046 A1 6/2007 Vovan
2007/0138180 A1 6/2007 Vovan
2007/0164026 A1 7/2007 Morrissey et al.
2007/0196541 A1 8/2007 Vovan et al.
2008/0000904 A1 1/2008 Vovan
2008/0006632 A1 1/2008 Vovan
2008/0110887 A1 5/2008 Ramsey et al.
2008/0185383 A1 8/2008 Philippe et al.
2008/0199108 A1 8/2008 Rogers
2009/0021026 A1 1/2009 Collier
2009/0032545 A1 2/2009 Zeiler et al.
2009/0057313 A1 3/2009 Alvares
2009/0120936 A1 5/2009 Zauser et al.
2009/0120942 A1 5/2009 Vovan
2009/0206082 A1 8/2009 Vovan

| | | | |
|---|---|---|---|
| 2010/0072205 | A1 | 3/2010 | Stuart |
| 2010/0072217 | A1 | 3/2010 | Parikh et al. |
| 2010/0155289 | A1 | 6/2010 | Nazareth et al. |

FOREIGN PATENT DOCUMENTS

| | | | |
|---|---|---|---|
| DE | 29819718 | U1 | 1/1999 |
| DE | 29914659 | U1 | 8/1999 |
| EP | 1559656 | A1 | 8/2005 |
| FR | 2819496 | | 1/2001 |
| GB | 2257118 | | 1/1993 |
| WO | WO 2005/082734 | | 9/2005 |
| WO | WO2005082733 | A1 | 9/2005 |

OTHER PUBLICATIONS

U.S. Appl. No. 11/230,978, Non-Final Rejection dated Jun. 2, 2008.
U.S. Appl. No. 11/230,978, Response to Non-Final Rejection dated Sep. 15, 2008.
U.S. Appl. No. 11/230,978, Supplemental Response dated Jan. 26, 2009.
U.S. Appl. No. 11/230,978, Final Rejection dated May 14, 2009.
U.S. Appl. No. 11/230,978, Response and RCE dated Aug. 13, 2009.
U.S. Appl. No. 11/230,978, Non-Final Rejection dated Sep. 10, 2009.
U.S. Appl. No. 11/230,978, Response to Non-Final Rejection dated Feb. 9, 2010.
U.S. Appl. No. 11/230,978, Final Rejection dated May 27, 2010.
U.S. Appl. No. 11/230,978, Response and RCE dated Aug. 27, 2010.
U.S. Appl. No. 11/230,978, Non-Final Rejection dated Sep. 16, 2010.
U.S. Appl. No. 11/230,978, Response to Non-Final Rejection dated Dec. 28, 2010.
Food Container purportedly published in Apr. 2005.
Safer Sandwiches, www.packagingtoday.co.uk—Packaging Today, purportedly published in Apr. 2005.
Tamper Evident Container, dated Sep. 13, 2004 and purportedly exhibited in a foreign country in Apr. 2005.
Tri-Star to Unveil First Ever Tamper Evident Salad Containers at Total Sandwich Show, Sandwich and SnacK News, purportedly published in Apr. 2005.
U.S. Appl. No. 12/626,476, filed Nov. 25, 2009.
U.S. Appl. No. 11/446,622, filed Jun. 5, 2006.
U.S. Appl. No. 11/446,622, Notice of Allowance dated Oct. 19, 2009.
U.S. Appl. No. 11/446,622, Amendment After Final dated Sep. 15, 2009.
U.S. Appl. No. 11/446,622, Final Rejection dated Jun. 24, 2009.
U.S. Appl. No. 11/446,622, Amendment dated Jun. 5, 2009.
U.S. Appl. No. 11/446,622, Non-Final Rejection dated Jan. 26, 2009.
U.S. Appl. No. 11/230,978, Non-Final Rejection dated Apr. 15, 2011.

* cited by examiner

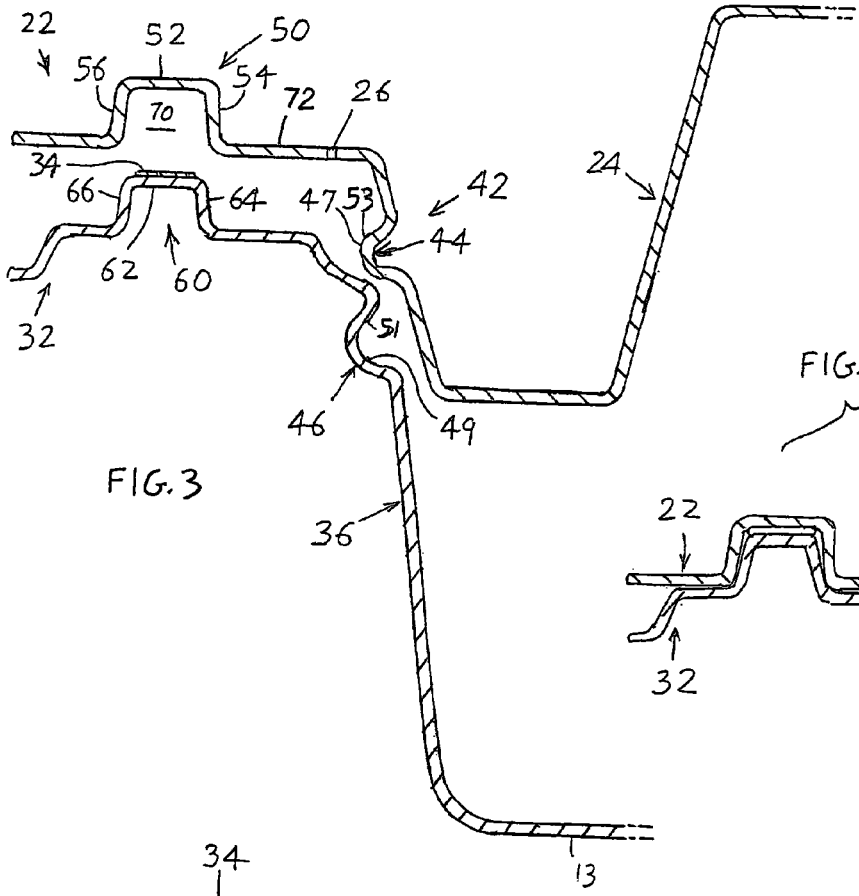
FIG. 3
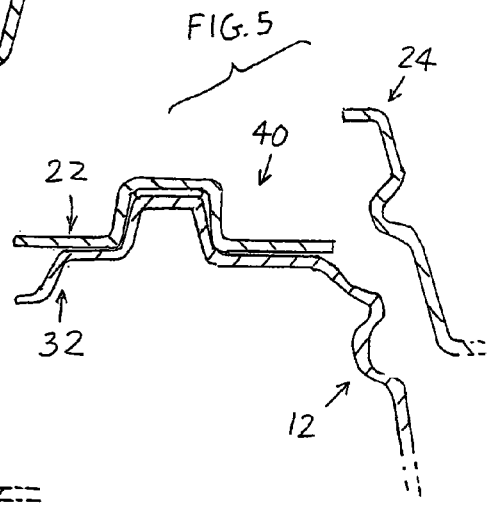
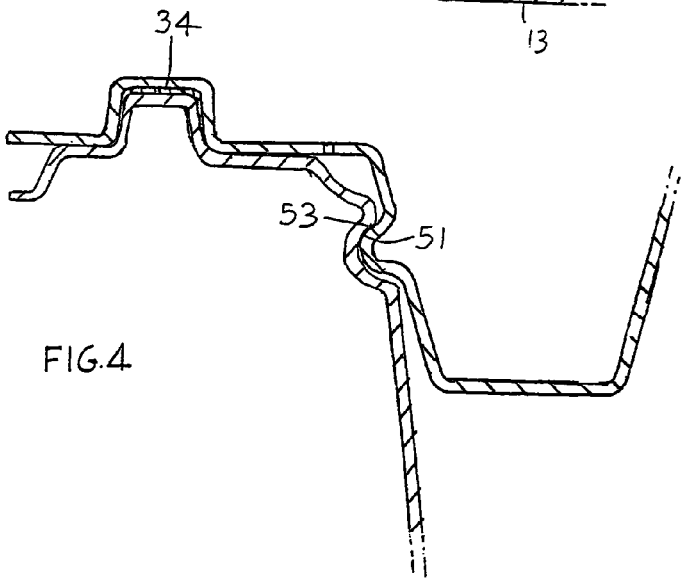
FIG. 4

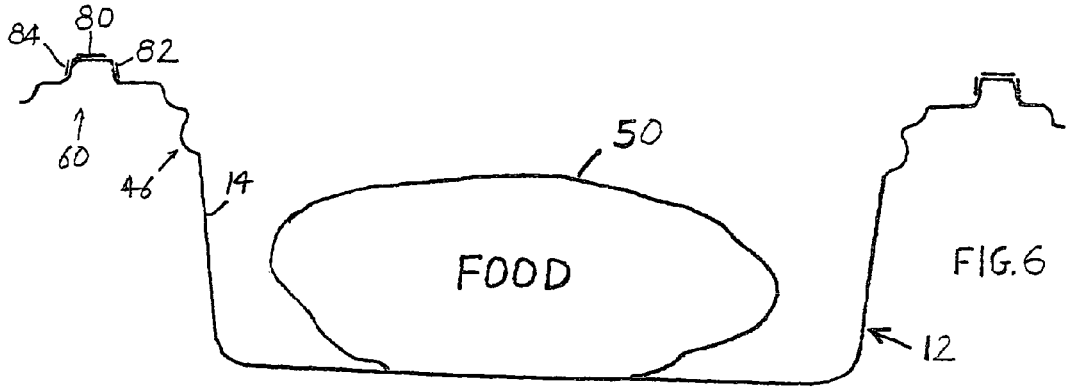
FIG. 6
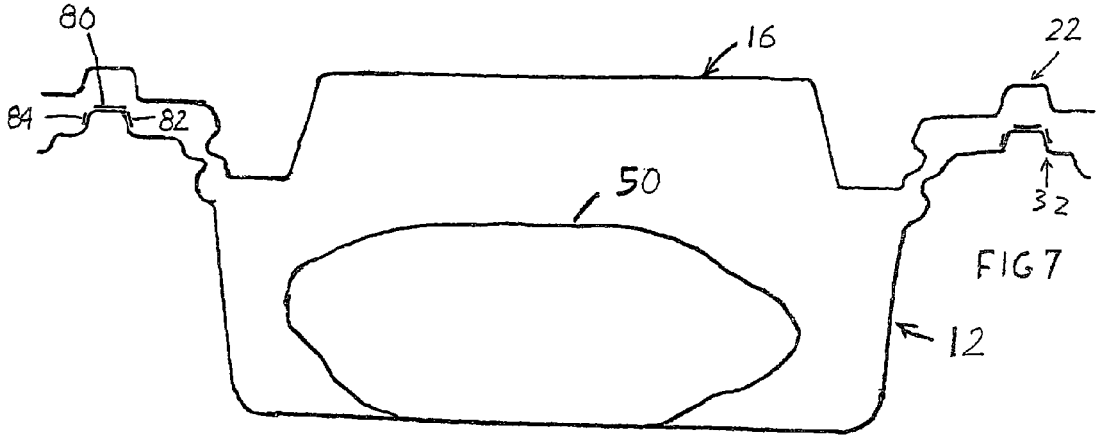
FIG 7
FIG. 8
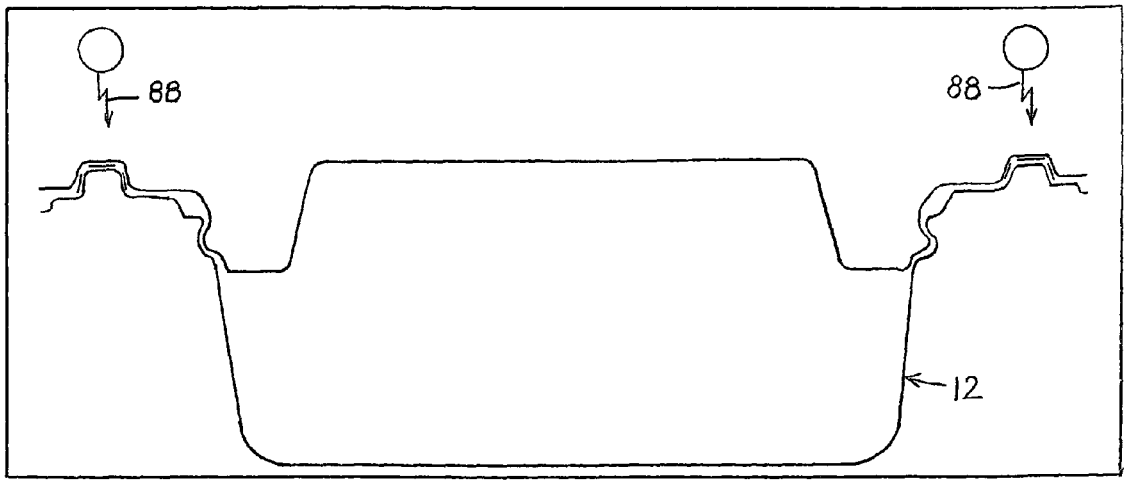

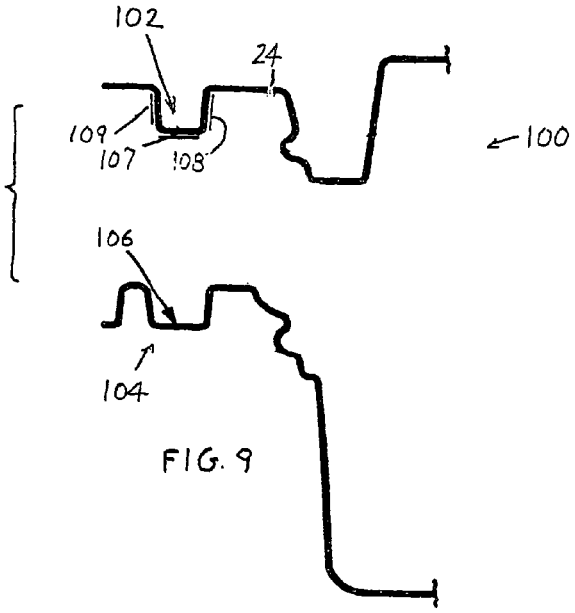
FIG. 9
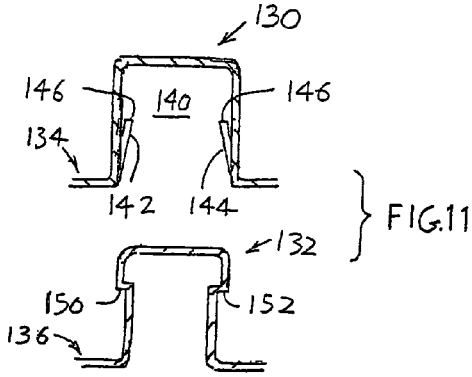
FIG. 11
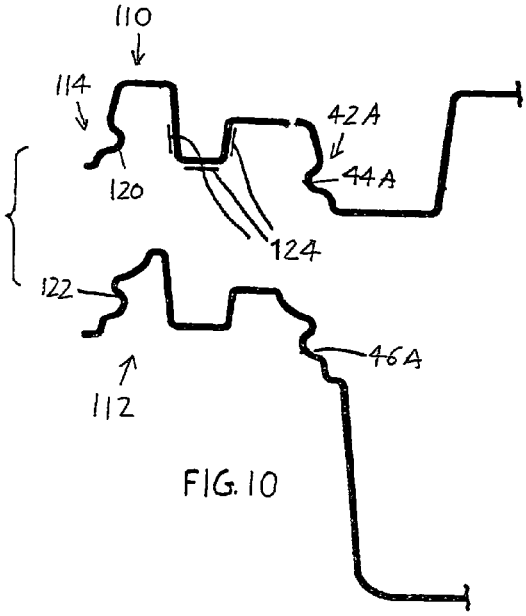
FIG. 10
FIG. 12
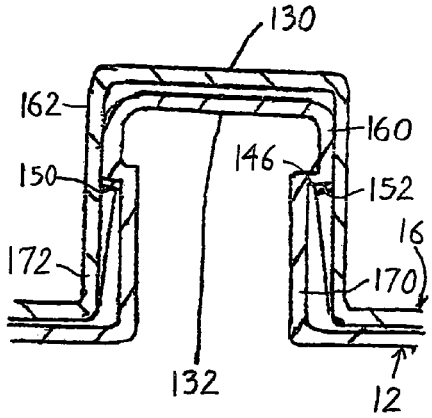

ENHANCED TAMPER EVIDENT CONTAINER WITH TEAR-APART PARTS

CROSS REFERENCE

Applicant claims priority from U.S. Provisional Patent Application Ser. No. 60/689,394 filed Jun. 10, 2005. This is a continuation of Ser. No. 11/446,622 filed Jun. 5, 2006.

BACKGROUND OF THE INVENTION

Food is often placed in a transparent container that includes a base with an upwardly-opening cavity that holds food and with a lid that closes the cavity. Buyers want to be assured that, after the food was placed in the container as by a clerk at the food store (who often wears plastic gloves to avoid food contamination), that the container has not been opened. There is a possibility that another customer has secretly opened the container enough to taste a bit of the food before closing it (and possibly leaving germs from his/her finger in the food). Potential buyers want to be assured that this has not happened. A container constructed by the container manufacturer that allowed a clerk at a store to easily close the container and lock it closed, and that thereafter clearly indicated to a potential customer whether or not the container has been opened since it was first closed by the clerk, would be of value. The clear indication of tampering is especially useful for containers that hold food, but is also useful for containers that hold many small nonfood items to assure a customer that some of the original items have not been taken.

SUMMARY OF THE INVENTION

In accordance with one embodiment of the invention, a container is provided of the type that includes a base and covering formed of plastic sheeting, which allows the container to be initially closed as by a store clerk, and which thereafter prevents the container from being casually and secretly opened. The container can be initially opened only by applying a large sustained pull force to separate a lid of the covering from a peripheral cover portion that is fixed to a peripheral base portion of the base. After being initially opened, the lid can be easily replaced on the base (which is now a base device that includes the peripheral cover portion) and the lid latches itself closed on the base and can be easily opened.

The container is supplied by the manufacturer so when the covering is initially closed on the base, as by a store clerk pushing the covering onto the base and activating an adhesive, the peripheral cover portion becomes fixed to a peripheral portion of the base. The covering includes a tear line, such as a line of perforations, that separates the peripheral cover portion from the lid. After such initial closing of the container, initial opening of the container requires that the lid be lifted to tear it free of the peripheral cover portion. The fact that the lid has been torn free of the peripheral cover portion, is obvious when looking at the container, so a potential buyer of the food-holding container is assured that food in the container has not been touched by another customer.

The novel features of the invention are set forth with particularity in the appended claims. The invention will be best understood from the following description when read in conjunction with the accompanying drawings.

DESCRIPTION OF THE DRAWINGS

FIG. 3 is a sectional view of a portion of a container taken on line 3-3 of FIG. 1, but with the base and covering separated prior to initial closing of the container.

FIG. 4 is a view of the container similar to the view of FIG. 3, but with the base and covering after they have been initially closed and before they have been initially opened.

FIG. 5 is a view of the container similar to the view of FIG. 4, after the container has been initially opened following its initial closing, showing that the lid of the covering has been separated from a base device formed by the base and peripheral cover portion.

FIG. 6 is a sectional side view of the container of FIG. 1, after food has been loaded into the base, but before the covering has been closed on the base, and with two additional strips of adhesive.

FIG. 7 is a view similar to that of FIG. 6, showing the covering as it approaches the base during the initial closing of the container.

FIG. 8 is a view similar to that of FIG. 7, but with the covering lying in the closed position on the base, and during the application of ultraviolet light to activate a quantity of adhesive that fixes the covering to the base.

FIG. 9 is an exploded view of a portion of a covering and of a base, which is similar to that of FIG. 3, but with the hat parts of the cover and base peripheral portions upside-down from the positions of FIG. 3.

FIG. 10 is an exploded view of a portion of a covering and of a base, which is similar to that of FIG. 9, but with additional latch parts for assuring good adhesion of the covering to the base.

FIGS. 11 and 12 are partial sectional views of a covering and a base of another embodiment of the invention, wherein the covering and base are fixed together only by mechanical parts of each of them.

DESCRIPTION OF THE PREFERRED EMBODIMENTS

Figure 1:
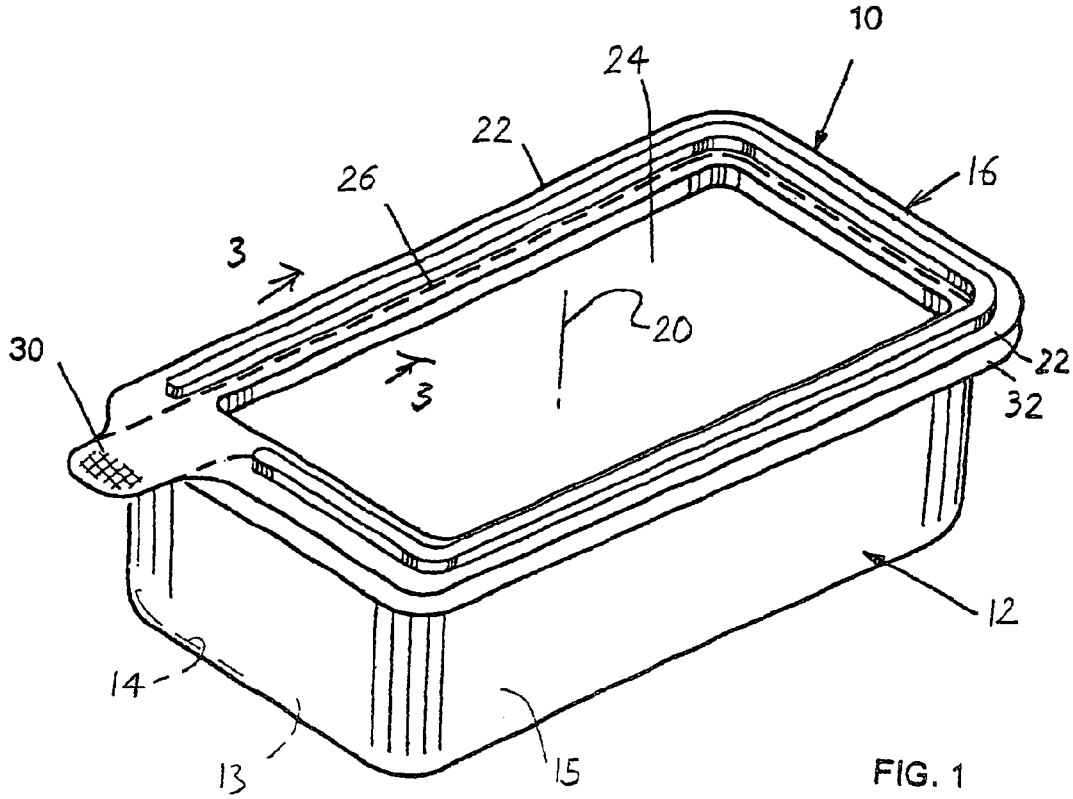
FIG. 1 is a top isometric view of a container of the present invention.

FIG. 1 shows a container 10 which includes a basically rectangular base 12 with a bottom 13 four sides 15, that forms an upwardly opening cavity 14, and a covering 16 that covers the base. Both the base and covering are formed of plastic sheeting, such as by two sheets of transparent plastic that have been vacuum formed, each of 0.020 inch thickness. The container has a vertical axis 20. The covering includes a peripheral cover portion 22 that is fixed to the base, and also includes an inner cover portion or lid 24 with a majority of the lid lying radially inward (with respect to axis 20) of the peripheral cover portion. A tear line 26 lies between the peripheral cover portion 22 and the lid 24. A lift tab 30 can be pulled up forcefully (e.g. with a force of 10 pounds) while the peripheral base portion 22 is held down, to tear the tear line and thereby separate the lid from the peripheral cover portion. FIG. 3 also shows skirts, or primarily horizontal flanges 22', 32' with free outer edges 23, 25 on the base and outer cover portion, with the base flange outer edge 25 lying below the cover flange outer edge 23. FIG. 4 shows that the vertical gap between the flanges 22', 32' is a plurality of times the thickness of the sheet plastic.

FIG. 3 shows the tear line 26 that separates the peripheral cover portion 22 from the lid 24. The base has a peripheral base portion 32 to which the peripheral cover portion 22 can be fixed, by a quantity of adhesive 34. The base also has a radially inner base portion 36. After the peripheral cover portion 22 has been fixed to the peripheral base portion 32, and the lid has been torn free along the tear line 26, the lid 24 is free as shown in FIG. 5. The peripheral cover portion 22 remains on the base as shown in FIG. 5. Together, the base 12 and the peripheral cover portion 22 form a base device 40. The lid can be repeatedly closed on the base device and easily lifted off of it.

As shown in FIG. 3, the container has a latch 42 that includes a lid latch part 44 that can readily latch to a base latch part 46. The lid latch part has a radially outwardly (O) extending projection 47 (i.e. generally away from the container axis), while the base latch part has a radially-inward (I) opening recess 49. The latch in its closed position in FIG. 4, prevents unlatching unless inclined shoulders 51, 53 on the base and lid are deflected horizontally. The inclined shoulders allow the lid to be pulled free of the base by applying a moderate upward force such as 3 pounds to the lift tab.

FIG. 3 shows that the peripheral cover portion 22 includes a covering hat part 50 that includes a flat primarily horizontal hat middle wall 52 and radially inner and outer hat side walls 54, 56 that are flat and extend primarily vertically. The peripheral base portion 32 has a base hat part 60 that includes a flat primarily horizontal middle wall 62 and flat opposite side walls 64, 66. When the covering is pressed down against the base, one of the hat parts fits into the other hat part. In FIGS. 1-8, the covering hat part 50 has a downwardly-opening recess 70 that receives the upwardly-projecting base hat part. When the hat parts fit into one another, their side wall lie facewise adjacent to each other. A quantity of adhesive on any of the walls then can bond the walls together. In FIG. 3 the quantity of adhesive 34 in the form of a self-contained strip has been placed on the hat middle wall 62 of the base. The side walls of the hat parts resist relative horizontal movement of the peripheral portions even without adhesive. The covering has a covering transition portion 72 that extends primarily horizontally and that separates the covering hat part 50 from the tear line 26. The transition portion 72 has a radial horizontal length at least as great as that of the hat middle walls (52, 62).

FIG. 6 though 8 show three steps in the handling of the container by a store clerk. Initially, many bases 12 are shipped in a stack and many coverings 16 are shipped in a separate stack. In FIG. 6, all three sides of the base hat part 60 are covered with adhesive. FIG. 6 shows three strips of activatable adhesive such as 80, 82 and 84 which lie on each of the three sides of the base hat 60. The adhesive is not activated, so its will not yet bond the base hat to the covering hat. A clerk in a food store who is normally wearing plastic gloves, takes a base from its stack and loads goods such as food 50 (FIG. 6) into the base cavity. As shown in FIG. 7, the clerk then pushes down the covering 16 onto the base. The clerk makes sure that the peripheral cover portion 22 is well seated on the base. As shown in FIG. 8, the clerk then places the container with food therein, in a UV (ultraviolet light) chamber 86. In the chamber, ultraviolet light 88 is directed onto the adhesive to activate it so the adhesive strongly bonds the peripheral portions of the covering and of the base. The container is now ready for display for sale, and customers can see that the container has not been opened because the tear line has not been ripped.

Figure 2:
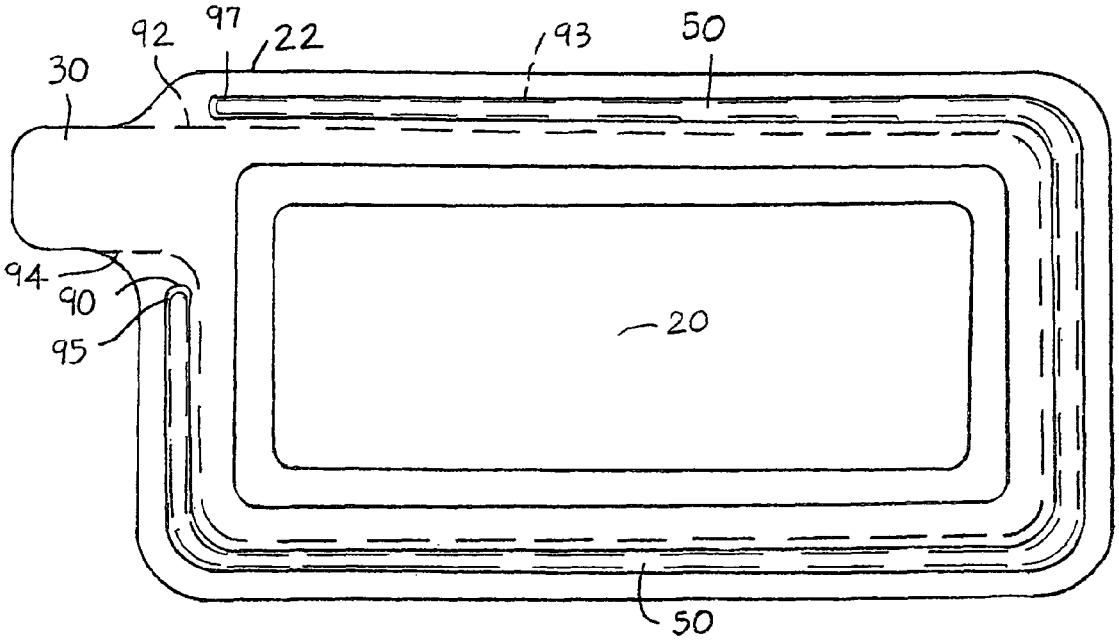
FIG. 2 is a plan view of the container of FIG. 1.

FIG. 3 shows adhesive 34 which has been applied to only the base hat middle wall 62, although adhesive could be applied to the base hat side walls as in FIGS. 6-8. FIG. 2 shows that the tear line 26 extends on either side of the lift tab 30 to the extreme edge of the covering. The lift tab extends horizontally at least one-quarter inch radially beyond the covering so it can be easily grasped. The peripheral cover portion ends at opposite tear line ends 92, 94 which lie in a gap 90. FIG. 2 also shows that the hat parts such as the covering hat part 50, extend around the entire container periphery except for the gap 90 around the lift tab 30. The adhesive is preferably applied along the entire container periphery except for the gap 90. The adhesive is preferably in the form of a strip 93 that extends along the entire lengths of the hat parts, although there can be gaps in such strip of adhesive. The adhesive strip should lie at 95 and 97 on opposite sides of the tear gap 90. It is possible to provide one or more strips of contact adhesive with inner faces that are bonded to one of the hat parts at the container manufacturing factory, and with outer faces that are protected with peel-off strips. In that case, the adhesive is activated (made ready to stick to a surface it contacts) by the clerk peeling off the peel-off strip. However, the strongest bonding is usually obtained by an adhesive that is activated by shining ultraviolet light at the adhesive. The adhesive is preferably applied to the one of the two hat parts with exposed surfaces (that do not lie in a recess) to be bonded to.

FIG. 9 shows another container 100 which is modified from the container of FIG. 3 by the covering hat part 102 projecting downward so all of its lower surfaces are exposed. The base hat part 104 forms an upwardly-opening recess 106 that receives the covering hat part and adhesive strips 107, 108, 109 on the covering hat part.

FIG. 10 shows another container which is similar to that of FIG. 9, except that the peripheral covering portion 110 and peripheral base portion 110, 112 are formed with a mechanical outer latch device 114 that includes outer latch device parts 120, 122. This is in addition to the lid latch 42A which has a covering part 44A and a base latch part 46A. The outer latch device 114 (in addition to latch 42A) holds the peripheral covering portion closed firmly on the peripheral base portion, so the orientations of the hat part walls and of the adhesive strips is more closely controlled. This helps assure that adhesive strips 124 will bond to both pairs of adjacent walls of the hat parts as well as the horizontal hat wall.

FIG. 11 illustrates another design of hat parts 130, 132 on the peripheral parts 134, 136 of the covering and the base. The covering hat part 130 forms a recess 140 and forms a pair of tabs 142, 144 with free upper ends 146, that project into the recess. The free upper ends form upwardly-facing shoulders. The base hat part 132 forms a pair of downwardly-facing shoulders 150, 152. When the base hat part is inserted into the recess of the covering hat part as in FIG. 12, the downwardly-facing shoulders of the base hat part engage the upwardly-facing shoulders on the tabs, and prevent the peripheral base part 136 from separating from the covering. The top connection parts of the lid and base engage each other in a snap fit. Applicant prefers to provide many pairs of tabs 142, 144 along the length of the hats around the container, or one very long pair of tabs. Applicant prefers to taper the heights of the tabs and/or shoulders that engage the tabs. This assures that a long length of tab(s) and shoulders are engaged when the lift tab 30 (FIG. 1) is lifted far enough to begin tearing along the tear line. The tabs and shoulders lie at the locations 95, 97 (FIG. 2) on opposite sides of the tear gap 90.

In FIG. 12, the lower hat part 132 is the inner hat part, which is received in the upper or outer hat part 130. FIG. 12 shows that the deepest projecting end 160 (the upper end in FIG. 12) of the inner hat part 132 rests in the deepest end 162 of the outer hat part, and the deepest ends of the hat parts (160, 162) engage each other. The shallowest interfitting ends 170, 172 of the hat parts do not engage each other. Also, the shoulders 150, 152 of the inner hat part engage shoulders formed at 146. This interference fit of hat parts resists separation of the covering 16 from the base 12.

In one example, the container is constructed of two separate sheets of approximately 0.020 inch thick (0.01 to 0.06 inch) transparent plastic, and has a container width of 5 inches and a container length of 8 inches except at the lift tab.

In one example, the container is constructed of two separate sheets of 0.020 inch thick transparent plastic, and has a container width of 5 inches and a container length of 8 inches except at the lift tab.

Thus, the invention provides a tamper evident container that includes a base and covering with peripheral portions that are readily fixed to one another when a clerk loads food or other goods into the base and closes the covering on the base. In one container, adhesive lies on at least one of the peripheral portions and a clerk easily activates the adhesive as by directing ultraviolet light at it. The covering includes a lid that is joined to the peripheral covering portion by a tear line. When a consumer who has bought the container filled with goods decides to open it, the consumer has to apply a sustained force, such as a force applied along a distance of 7.5 inches for a container of a length of 8 inches, with the container making considerable noise when the tear line is torn. The tear force is large, such as 10 pounds. The lid and base form a latch so that after the container is opened by a customer, it requires the application of a smaller force such as a downward force of 3 pounds applied along a distance such as one-quarter inch, to close the container, and a similar upward force and force-applied distance to reopen the container. The fact that the container makes considerable noise when initially opened after a clerk has initially closed the container, the large initial opening force and force-applied distance, and the fact that the container clearly indicates when it has been opened, makes it unlikely that a customer will secretly open the container and assures customers that the container has not been opened.

Although particular embodiments of the invention have been described and illustrated herein, it is recognized that modifications and variations may readily occur to those skilled in the art, and consequently, it is intended that the claims be interpreted to cover such modifications and equivalents.

What is claimed is:

1. A tamper evident container which has a vertical axis and which includes a base that forms an upwardly-opening cavity and a covering which is closed on said base to cover said cavity, said base and said covering being formed of plastic sheeting, wherein said covering includes radially inner and outer covering portions with a tear line between them, said inner covering portion being separable from said outer covering portion by tearing them apart along said tear line, said covering constructed so that after said covering portions are separated along said tear line said inner covering portion is easily lifted off and pressed back onto said base, wherein:

said inner covering portion has a handle in the form of a tab that can be grasped to tear the inner covering portion free of the outer covering portion;

said tear line extends only horizontally, and said tab extends horizontally, wherein said tab has opposite sides and said tear line has tear line ends that extend horizontally along said opposite sides of said tab.

2. The container described in claim 1 wherein:

said container is of primarily rectangular shape as seen in a plan view taken along said axis, with said container having four container sides and four corners, said tab lies at one of said corners, and said tab has opposite tab sides that extend parallel to two of said container sides.

3. A tamper evident container which has a vertical axis and which includes a base that forms an upwardly-opening cavity and a covering which is closed on said base to cover said cavity, said base and said covering being formed of plastic sheeting, wherein said covering includes radially inner and outer covering portions with a tear line between them, said inner covering portion being separable from said outer covering portion by tearing them apart along said tear line, said covering constructed so that after said covering portions are separated along said tear line said inner covering portion is easily lifted off and pressed back onto said base, wherein:

said inner covering portion has a handle in the form of a tab that can be grasped to tear the inner covering portion free of the outer covering portion;

said tear line extends only horizontally, and said tab extends horizontally, said base and said outer portion of said covering each has a hat-shaped covering part with one hat-shaped covering part fitting into the others, said hat-shaped covering parts extending around the entire container and ending at said opposite sides of said tab.

4. A tamper evident container which has a vertical axis, comprising a base which forms an upwardly-opening cavity and a covering which is closed on said base to cover said cavity, said base and said covering being formed of plastic sheeting, said covering having a peripheral covering portion that is fixed to said base, and said covering having a radially inner covering portion that lies on said axis and that forms a lid that is joined to said peripheral covering portion by a tear line where said covering is weakened and can be torn by manually applying a lifting force to the lid, so the lid can be removed while the peripheral covering portion remains with the base, wherein:

said lid has a tab with horizontal opposite sides, said tear line has first and second opposite tear line ends that extend parallel to each other along said tab opposite sides, and said tear line extends horizontally and parallel to said first tear line end away from said tab, so the tear line can be torn in a single horizontal direction along said first tear line end and away from said tab.

5. The container device described in claim 4 wherein:

said container is of primarily rectangular shape as seen in a plan view taken along said axis, with four sides and four corners, and said tab lies at one of said corners and extends parallel to one of said sides.

6. A tamper evident container which has a vertical axis, comprising:

a base which forms an upwardly-opening cavity;

a covering which is closed on said base to cover said cavity, said base and said covering being formed of deformed plastic sheeting;

said covering includes a centrally-located inner covering portion and a peripheral covering portion, with a horizontal tear line between said inner covering portion and at least a portion of the peripheral covering portion, said inner covering portion being separable from said at least a portion of the peripheral covering portion by tearing along said tear line;

said covering further comprising a tab to tear along the tear line, the tab defined at least in part by a first tear line end of said tear line extending horizontally along a first side of the tab, the tab further defined by a second tear line end extending horizontally along a second side of the tab, wherein the tab extends horizontally.

7. The container described in claim 6 wherein:

said container has a latch that includes a lid latch part forming a radially outward projection in said inner covering portion, and a base latch part forming a radially inward-opening recess in said base, said projection entering said recess when said inner covering portion is closed on said base.

8. The container described in claim 6 wherein:

said base and said peripheral covering portion have radially outer flanges that are horizontal and have radially outer edges that lie with one directly under the other and that are vertically spaced apart.

9. The container described in claim 6 wherein:

said covering is of thermally deformed plastic sheeting.

10. The container of claim 6, wherein:

the base further comprises a base hat connection part; and the covering further comprises a covering hat connection part;

the hat connection parts of the lid and the base each comprising a pair of radially spaced side walls connected by a middle wall, wherein the covering hat connection part is adjacent the tear line.

11. The container of claim 6, wherein:

said base has a base latch part with a radially inward opening recess and said inner covering portion has a covering latch part that forms a radially outward projection that fits into said base latch part recess, with said latch parts fixing the height of said inner covering portion before and after said inner covering portion is torn apart from said at least a portion of the peripheral covering portion and lifted off said base and said inner covering portion is replaced on said base;

said covering has a horizontal surface and said tear line extends only horizontally, so no part of said tear line extends partly or completely vertically.

12. The container of claim 6, wherein:

said peripheral covering portion has an outer periphery forming a cover skirt that projects radially outward and that has a free radially outward edge;

said base has a base outer periphery forming a skirt that is parallel to and lies under said cover skirt of said peripheral covering portion;

there is a vertical gap between said skirts that is a plurality of times the thickness of said plastic sheeting, whereby said cover skirt can be grasped to lift said peripheral covering portion.

13. The container described in claim 12 wherein:

said base skirt has a free edge that lies directly under said cover skirt free edge, whereby to facilitate grasping both of said free edges.

14. The container of claim 6 wherein:

said container has a latch that includes a base latch part formed in said base and a lid latch part formed in said inner covering portion, said container latch extending around a majority of said container and constructed to resist lifting the inner covering portion off said base but to allow the inner covering portion to be lifted off the base when a sufficient upward force is applied to said inner covering portion, and to allow the inner covering portion to be reinstalled on the base when a sufficient force is applied downward to said inner covering portion;

said base latch part having a radially inward opening recess and said lid latch part having a radially outwardly projecting projection that fits in said recess, to prevent direct access to said recess and projection.

15. The container described in claim 14 wherein:

said peripheral covering portion has a radially outward periphery forming a cover skirt that projects radially outward and has a radially outward edge;

said base has a radially outward periphery forming a skirt that is parallel to and lies under said skirt of said peripheral covering portion;

there is a vertical gap between said skirts that is a plurality of times the thickness of said plastic sheeting.

16. The container of claim 6 wherein:

the base has a base latch part with a radially inward opening recess;

said inner covering portion having a latch part which forms a radially outward projecting projection that fits into said base latch part recess, with said latch parts extending without interruption around a majority of the container to provide a sealing function, said covering constructed so, after said covering portions are separated, said inner covering portion latch latches and unlatches said base latch part when said inner covering portion is respectively lifted off and pressed back on said base.

17. The container described in claim 6 wherein:

said covering has a horizontal surface and said tear line extends solely along said horizontal surface.

18. The container of claim 6, wherein the peripheral covering portion is secured at least in part to the base.

19. The container of claim 18, wherein the peripheral covering portion extends around a periphery of the inner covering portion except at a gap proximate the tab.

20. The container of claim 6, wherein the second tear line end is a second end of the tear line.

21. The container of claim 6, wherein the tab is coplanar with the inner covering portion.

22. The container of claim 6, wherein the covering further comprises a horizontal transition portion between the inner covering portion and the at least a portion of the peripheral covering portion, with the tear line formed only in the horizontal transition portion and not in any vertical surface.

23. A tamper evident container which has a vertical axis and which includes a base that forms an upwardly-opening cavity and a covering which is closed on said base to cover said cavity, said base and said covering being formed of plastic sheeting, wherein said covering includes radially inner and outer covering portions with a tear line between them, said inner covering portion being separable from said outer covering portion by tearing them apart along said tear line, said covering constructed so that after said covering portions are separated along said tear line said inner covering portion is easily lifted off and pressed back onto said base, wherein:

said base and said outer portion of said covering each has a hat part having a deep end and a shallow interfitting end with one hat part being an inner hat part and the other hat part being an outer hat part that receives the inner hat part, until the deep ends of said hat parts nest in each other, with said inner and outer hat parts lying in an interference fit with each other to resist separation of said base and covering but with the shallow interfitting ends of the hat parts not lying out of engagement with each other.

24. The container described in claim 23 wherein:

a first of said covering portions has at least one outward projecting tab that can be grasped to tear it free of the other covering portion.

25. The container described in claim 24 wherein:

said tab has opposite sides and said tear line has tear line ends that extend horizontally along said opposite sides of said tab.

* * * * *